US005927369A

United States Patent [19]

Pedersen

[11] Patent Number: 5,927,369

[45] Date of Patent: Jul. 27, 1999

[54] LIFT GATE

[75] Inventor: Torben Pedersen, Haderslev, Denmark

[73] Assignee: Lindab, Haderslev, Denmark

[21] Appl. No.: 09/029,896

[22] PCT Filed: Sep. 13, 1996

[86] PCT No.: PCT/EP96/04038

§ 371 Date: Mar. 11, 1998

§ 102(e) Date: Mar. 11, 1998

[87] PCT Pub. No.: WO97/10405

PCT Pub. Date: Mar. 20, 1997

[30] Foreign Application Priority Data

Sep. 13, 1995 [DK] Denmark ..... 9500353

[51] Int. Cl.[6] ..... E05D 15/10

[52] U.S. Cl. ..... 160/201; 160/229.1

[58] Field of Search ..... 160/201, 229.1, 160/232, 40, 199, 206, 207, 235, 41

[56] References Cited

U.S. PATENT DOCUMENTS

| | | | |
|---|---|---|---|
| 3,941,180 | 3/1976 | Thill | 160/229.1 |
| 5,002,114 | 3/1991 | Hormann | 160/201 X |
| 5,148,850 | 9/1992 | Urbanick | 160/229.1 X |
| 5,170,832 | 12/1992 | Wagner | 160/229.1 X |
| 5,522,446 | 6/1996 | Mullet et al. | 160/229.1 |
| 5,669,431 | 9/1997 | Druzynski et al. | 160/229.1 |

FOREIGN PATENT DOCUMENTS

| | | |
|---|---|---|
| 0 370 376 | 5/1990 | European Pat. Off. . |
| 0 381 663 | 8/1990 | European Pat. Off. . |
| 39 04918 | 8/1989 | Germany . |

*Primary Examiner*—David M. Purol
*Attorney, Agent, or Firm*—Rabin & Champagne, P.C.

[57] ABSTRACT

A lift gate has elements which extend across the gate in its entire width. The elements are positioned vertically above each other, and are interconnected on their rear sides by hinges countersunk with respect to the rear side. The elements are guided in a pair of substantially vertical tracks along the sides of the gate. The tracks are bent at the upper edge of the gate in an approximately horizontal direction toward the rear side of the gate. The elements have a cross-sectionally tooth-shaped projection along their upper edge, and a corresponding depression along their lower edge. The depression accommodates the projection of an adjoining element. A cutting plane extends perpendicular to the element and through the hinge axis, and cuts a profile section which, in cross-section, approximately forms a triangle having a front flank and a rear flank, and which, when the gate is closed, extends from the lower edge of the overlying element upwards toward the vertex of the triangle. On the rear side of the tooth-shaped projection along the upper edge, the elements have a rearwardly directed projection which extends in the longitudinal direction of the element, and which, in the closed state of the gate, is positioned between the hinge and the lower edge rearwardly of the overlying element and which, when the gate is opened, forms a gap whose width is smaller than a finger thickness.

13 Claims, 1 Drawing Sheet

LIFT GATE

BACKGROUND OF THE INVENTION

The present invention concerns a lift gate having a plurality of elements which extend across the gate in its entire width and are positioned vertically above each other, and which are interconnected on their rear sides by hinges, countersunk with respect to the rear side, and are guided in a pair of substantially vertical tracks along the sides of the gate. The track are bent at the upper edge of the gate in an approximately horizontal direction behind the gate. The elements have a crosssectionally tooth-shaped projection along the upper edge and a corresponding depression along the lower edge. The depression is capable of accommodating the projection on an adjoining element. A cutting plane is perpendicular to the element and through the hinge axis, and cuts a profile section which, in cross-section, approximately forms an equilateral triangle having a front flank and a rear flank which, when the gate is closed, extends evenly and approximately symmetrically from the lower edge of the overlying element upwards toward the vertex angle of the triangle. The lower edge on the front side of the element is positioned below the cutting plane when the gate is closed.

A lift gate approximately corresponding to this description is known from DE-A-39 04 918. The tooth-shaped projection cooperates with the front lower edge of the overlying element in such a manner that just a quite small gap is formed between the two elements when the elements at the upper side of the gate are tilted rearwards and are moved horizontally into the space behind the gate. In practice, the gap that is formed will be less about 5 mm, without special considerations being paid in the construction of the gate, if the angle between the elements during tilting is kept below 60°. As long as the gap is less than 5 mm, it is considered that a person gripping the elements on the front side of the gate cannot move his fingers into the gaps between the elements and, when the gate is pulled down, does not risk getting his fingers crushed when the gap closes again.

EP Patent Specification 608 683 discloses a lift gate whose elements are formed with means which provide a safeguard against finger squeezing at the outer side of the gate as well as at its inner side. Protection against finger squeezing is obtained at the front side of the gate for tilting angles of up to 65° by placing the lower edge of the front side of the upper element below a horizontal cutting plane through the hinge axes when the gate is closed. A flap, curved in profile, is placed on the rear side along lower edges of the upper element, and this flap, behind the hinges, engages a correspondingly curve-shaped groove in the rear side of the underlying element. The provision of the lower edge on the rear side of the elements, combined with the front side lower edge positioned at a low level, makes it difficult to mount the elements, which can be assembled to a gate only if the elements are pushed together in a tilted state and are then raised to the state in which the elements are in the same plane. Furthermore, the lower edge at the rear side of the elements is relatively fragile, so that it is easily damaged, while forming a relatively slender basis for the attachment of the hinges.

SUMMARY OF THE INVENTION

The object of the invention is to provide a lift gate which obviates the above-described drawbacks, and which allows the elements to be mounted by pushing them together in the same plane. Further, it must be possible to allow tilting angles of about 70°, without this involving any risk of finger squeezing at the front side or the rear side of the lift gate.

This is achieved according to the invention, in that the gate is characterized by providing, on the rear side of the tooth-shaped projection along the upper edge, a rearwardly directed projection which extends in the longitudinal direction of the element, and which, in the closed state of the gate, is positioned between the hinge and the lower edge rearwardly of the overlying element and which, when the gate is opened, forms a gap whose width is smaller than a finger thickness.

In the invention, the lowermost edge of the overlying element is pulled further down than the level of the hinge, whereby the front flank of the tooth-shaped projection is swept over a greater angle than the 60° which corresponds to the cross-section of the projection shaped as an equilateral triangle. In combination with this, the hinge at the countersink has been moved closer to the front side, thereby generally reducing the dimensions of the projection and thus also the size of the gaps that open during tilting between the elements. The projection positioned on the rear side of the elements provides a safeguard against squeezing and also a sealing area, which is instrumental in ensuring that the joints between the elements will be approximately wind-tight, and also that no condensation occurs in the joint in case of great temperature differences between indoors and outdoors. The lower edge of the rear side of the elements has a reasonably great strength, because it has a thickness corresponding to the countersink of the hinges, and hereby it provides a good basis for the hinge attachment.

It is expedient that the hinge is positioned in a recess below the projection, thereby enabling the use of relatively coarse and sturdy hinges as well as a relatively large countersink.

The elements are preferably constructed as sandwich elements having front and rear panels of metal plate and a core of a foamed plastics material. With such a selection of materials it is advantageous according to the invention that the rearwardly directed projection is formed by a joint between the plates forming the front side and the rear side of the element, the front side plate being preferably folded about the edge of the rear side plate.

Correspondingly, it is advantageous that the front lower edge of the elements is formed by a joint between the plates forming the front side and the rear side, the front side plate being preferably folded about the edge of the rear side plate.

It is advantageous according to the invention that dust and snow are prevented from penetrating into the joint between the elements, which is ensured according to the invention in that the front flank of the tooth-shaped projection has an undercut groove with a sealing strip embedded in it.

To relieve the hinges when the gate is closed, and to ensure that the elements form a plane and even front side and also resist a moderate, mechanical overload, it is preferred that the tooth-shaped projection at the top has two preferably symmetrically positioned facets with a mutual angle of, e.g., about 120°, the facets resting against two corresponding faces in the adjoining depression in the closed state of the gate. This feature may also be preferably applied to other kinds of lift gates which do not include all the specific features of claim 1.

BRIEF DESCRIPTION OF THE DRAWINGS

The invention will be described more fully below with reference to the drawings, in which.

DETAILED DESCRIPTION OF THE DRAWINGS

Figure 1:
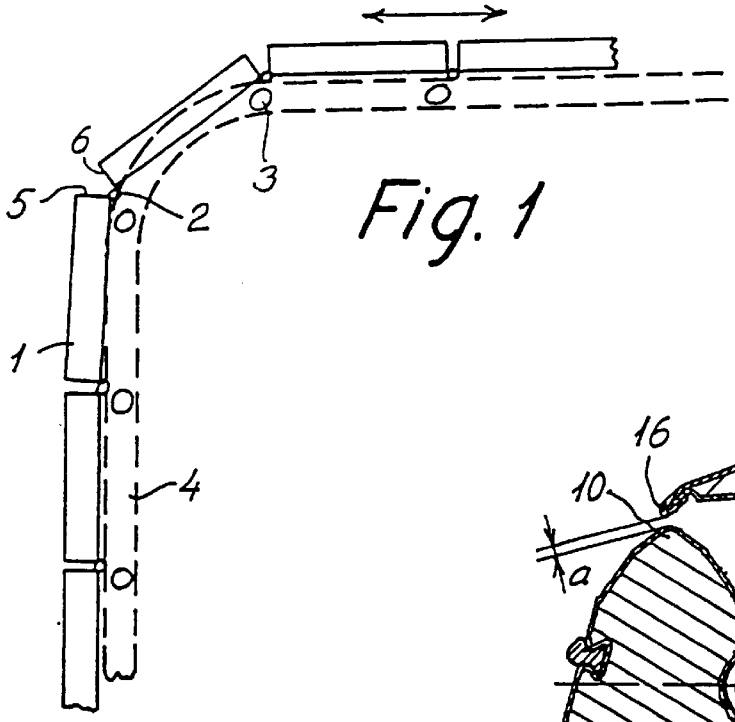
FIG. 1 is a schematic lateral view illustrating the guidance of the gate elements in a lift gate in the area along the upper side of the gate opening, the elements being guided horizontally into the space behind the gate along curved rails.

As appears from FIG. 1, a lift gate includes of individual gate elements 1 which are interconnected by means of hinges 2, link joints or the like, the axes of the hinges extending horizontally. Guide rollers 3 running in guide rails 4 or similar guide paths are mounted opposite the hinges at the ends of the elements. The guide rails are located with a vertical run along the gate opening and bend at the gate openings upper edge into a horizontal run. When the gate is closed, the interconnected gate elements are pulled out of the horizontal rail run and down into the vertical rail run. As appears from FIG. 1, this means that the elements tilt with respect to each other, and, correspondingly, the joints between the elements move like a jaw which opens and closes at the transition between the curved and straight runs of the rail track. If no special measures are taken, the joints between the elements may present a serious risk that a person operating the gate can get seriously hurt if he sticks one or more fingers into one of the gaps that occur between the upper edge 5 of one of the gate elements and the lower edge 6 of an adjoining gate element during closing of the gate.

Figure 2:
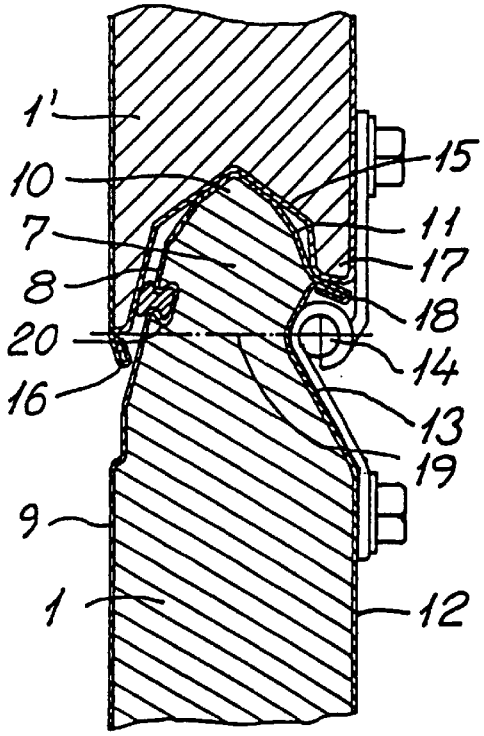
FIG. 2 is a section through the joint between two gate elements with the gate closed.

As appears from FIG. 2, each gate element 1, at its upper edge 5, has an upwardly extending projection 7 whose cross-section has the shape of an approximately triangular tooth. The projection has a front flank 8 which extends upwardly toward the tooth tip 10 from the front side 9 of the element. The evenly curved or slight facets. Toward the rear side of the element may have, the rear flank 11 correspondingly slopes evenly or 13 in the form of a polygone over a length thereof toward the rear side 12 of the gate element. In the area around the tooth tip 10, the front flank 8 and the rear flank 11 are approximately symmetrical about a plane which extends through the tooth tip 10 in the plane of the element 1. A recess 13 is provided on the rear side 1*a* of the element 1 below the evenly sloping extent of the rear flank 11, the recess serving to receive a hinge 14 which can connect the element 1 with an overlying corresponding element 1'. The hinge 14 is completely received within the recess 13. At its lower edge 6, the element 1' has a depression 15 which cooperates with the projection 7 and rests against the projection 7 at a base of the depression in the closed state of the gate, as shown in FIG. 2. The depression 15 is V-shaped at the base, and its walls slope toward the front side 9 substantially evenly or in the form of a polygone downwards toward the front lower edge 16 of the element, and a toward the rear side 12 substantially evenly or in the form of a polygone downwards toward a thickened rear lower edge 17 of the element 1'. The concepts upper edge and lower edge refer to the gate in its closed position in which the gate elements 1, 1' are positioned vertically above each other.

The thickened rear lower edge 17 abuts on the rear flank 11 of the tooth-shaped projection with an edge facing the depression in the area above the hinge 14. Immediately below this, the tooth-shaped projection has formed thereon a rearwardly extending projection 18 which extends into the relatively narrow gap between the hinge 14 and the thickened lower edge 17. The rearwardly directed projection 18 forms a transition between the even rear flank 11 and the recess 13 which accommodates the hinge. The rearwardly directed projection 18 serves to partly close the gap that may occur between the elements 1, 1' when they are tilted with respect to each other, and also serves as a joint between the metal plate front and rear panels in the elements. Preferably, the plate forming the front side is folded about the edge of the plate forming the rear side.

At the front side of the elements, the lowermost edge 16 of the upper element 1' is pulled so far down that the lower edge is present somewhat below a plane 19 extending through the hinge axis at right angles to the front and rear sides of the elements. The lower edge 16 is bent slightly inwards so as to be disposed close to the front flank 8 of the tooth-shaped projection 7. The lower edge 16 is preferably formed by a joint between the plates forming front and rear panels in the gate element, the front panel being folded about the projecting edge of the rear panel. It is not desirable that the lower edge 16 directly touches the front flank 8, one reason being that the surface finish of the elements may be damaged, but owing to the safeguard against finger squeezing the gap should be narrow, e.g. 0.5–1 mm. Therefore a seal between the elements is advantageously provided in that the front flank 8 is formed with an undercut groove 20 in which a sealing profile of elastic material may be embedded. In the closed state of the gate, the sealing profile adjoins the wall of the depression 15 in an area relatively close to the lower edge 16.

Figure 3:
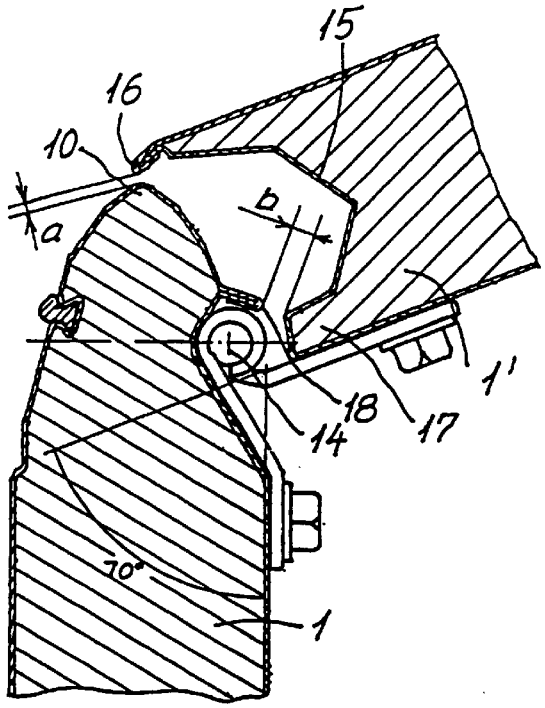
FIG. 3 shows the joint between two gate elements which are tilted with respect to each other in the area where the rails are bent.

When the gate is opened or closed, the elements 1, 1' are moved through the curved section of the rails 4. The elements are hereby tilted with respect to each other about the hinges 14. The angle between the elements depends on the radius of curvature of the rail and particularly on the height of the elements. For economic reasons, a relatively great height of the elements is usually desirable, which results in a relatively great tilting angle e.g. 70°. FIG. 3 shows the elements tilted with respect to each other at an angle of 70°. Owing to the lower edge 16 being positioned low with respect to the hinge 14, the gap occurring between the tooth tip 10 and the lower edge 16 will not assume such a great width a as will make it possible to insert a finger. It is readily possible to limit the width a not to exceed e.g. 2.5 mm. On the rear side of the gate, the rearwardly directed projection 18 forms a barrier in the gap that opens, and it is thereby possible to limit the width b of the gap to open max. about 5 mm, which is considered fully defensible by current standards to avoid finger squeezing. Generally, gap widths of up 10 mm are acceptable, which is a significantly greater value than the one obtainable by the invention.

The gate elements 1,1' may be produced as sandwich structures, i.e. with front and rear panels of metal plate and a core of foamed plastics or a correspondingly rigid, insulating material, e.g. hard mineral felt. The panels are provided with glued reinforcements in the areas where screws are to be inserted, e.g. to secure the hinges. To relieve the hinges 14 when the gate is closed, and the gate elements transfer the weight from overlying panels to underlying panels, it is ensured that the gate elements directly rest against each other. The tooth tip 10 has a pair of symmetrically shaped facets whose mutual angle is about 120°, and which fit in a correspondingly shaped portion in the depression 15. The angle 120° is adapted precisely so as to create an approximately even weight transfer along the faces which are in contact, thereby minimizing the risk of overloading the core material.

I claim:

1. A lift gate having a plurality of elements which extend across the gate in its entire width and are positioned vertically above each other, and which are interconnected on their rear sides by hinges, countersunk with respect to the rear side and are guided in a pair of substantially vertical tracks along the sides of the gate, said tracks being bent at the upper edge of the gate in an approximately horizontal direction toward the rear side of the gate, said elements having a cross-sectionally tooth-shaped projection along the upper edge and a corresponding depression along the lower edge, said depression being capable of accomodating the projection of an adjoining element, a cutting plane perpendicular to the element through the hinge axis cutting a profile section which, in cross-section, approximately forms a triangle having a front flank and a rear flank which, when the gate is closed, extend from the lower edge of the overlying element upwards toward the vertex of the triangle, characterized in that, on the rear side of the tooth-shaped projection along the upper edge, the elements have a rearwardly directed projection which extends in the longitudinal direction of the element, and which, in the closed state of the gate, is positioned between the hinge and the lower edge rearwardly of the overlying element and, when the gate is opened, releases a gap whose width is smaller than a finger thickness, said lower edge of the rear side of the elements thicknesswise preferably approximately corresponding to the size of the countersink of the hinge axis with respect to the rear-side of the elements.

2. A lift gate according to claim 1, characterized in that the hinge is positioned in a recess on the rear wall of the elements below the rearwardly directed projection.

3. A lift gate according to claim 1, characterized in that the elements are made of two metal plate panels with an intermediate, insulating core material, and in that the rearwardly directed projection is formed by a joint between the plate forming the front side and the plate forming the rear side of the element, the front side plate being preferably folded about the edge of the rear side plate.

4. A lift gate according to claim 1, characterized in that the elements are made of two metal plate panels with an intermediate, insulating core material, said metal panels being connected by means of longitudinal joints, and in that a joint is positioned at the front lower edge of the elements and is formed by a joint where the front side plate is preferably folded about the edge of the rear side plate.

5. A lift gate according to claim 1, characterized in that an undercut groove having a sealing strip embedded therein is provided on the front flank of the tooth-shaped projection.

6. A lift gate according to claim 1, characterized in that the tooth-shaped projection at the top has two symmetrically positioned facets with a mutual angle of about 120°, said facets resting against two corresponding faces in the adjoining depression in the closed state of the gate.

7. A lift gate according to claim 1, characterized in that said profile section approximately forms an equilateral triangle, the front flank and the rear flank of which extend, when the gate is closed, evenly or in the form of a polygone and at least approximately symmetrically form the lower edge of the overlying element towards the vertex of the triangle.

8. A lift gate according to claim 1, characterized in that said lower edge on the front side of the element being positioned below said cutting plane when the gate is closed.

9. An element of a lift gate, comprising:

a front side;

a rear side opposing the front side, and being adapted to receive a hinge in a countersunk relationship, the hinge pivotably connecting the element to an adjoining element of the lift gate;

a lower edge extending from the front side to the rear side, and having a depression formed therein, the depression separating the lower edge into a front lower edge, and a rear lower edge; and an upper edge extending from the front side to the rear side, and having a cross-sectional tooth-shaped projection, the tooth-shaped projection being receivable within a corresponding depression of the adjoining element of the lift gate, the tooth-shaped projection including an upper portion having a cross-sectional triangular shape defined by a front flank that extends from a vertex of the triangle toward the front side, and a rear flank that extends from the vertex of the triangle toward the rear side, the rear flank having a rearwardly-directed projection which extends in the longitudinal direction of the element, and which, when the tooth-shaped projection is received within the corresponding depression of the adjoining element of the lift gate, is positioned between the hinge and the rear lower edge of the adjoining element of the lift gate and which, when the tooth-shaped projection is pivoted out of the corresponding depression of the adjoining element of the lift gate, forms a gap with the rear lower edge of the adjoining element of the lift gate, whose width is smaller than a finger thickness.

10. The element of claim 9, wherein the width is not greater than about 5 mm.

11. The element of claim 9, wherein said rear side has a recess formed therein in a region toward the upper edge, the recess having a depth sufficient to completely receive a joint of the hinge therein.

12. The element of claim 11, wherein the rear lower edge of the element has a thickness that is about equal to the depth of the recess.

13. The element of claim 11, wherein the recess is located immediately adjacent to the rearwardly-directed projection, and between the rearwardly-directed projection and the rear lower edge.

* * * * *